US005324078A

United States Patent [19]

Bane

[11] Patent Number: 5,324,078

[45] Date of Patent: Jun. 28, 1994

[54] REMOVABLE LINERLESS LABEL ZIGZAG AND SHINGLED CONSTRUCTIONS

[75] Inventor: John C. Bane, Grand Island, N.Y.

[73] Assignee: Moore Business Forms, Inc., Grand Island, N.Y.

[21] Appl. No.: 997,171

[22] Filed: Dec. 28, 1992

[51] Int. Cl.[5] ..... B42D 15/00

[52] U.S. Cl. ..... 283/81; 281/2; 283/101; 40/310

[58] Field of Search ..... 283/74, 81, 79, 100, 283/101, 61, 62; 281/2, 5; 40/299, 310, 630; 428/40–43

[56] References Cited

U.S. PATENT DOCUMENTS

| | | | |
|---|---|---|---|
| 2,091,346 | 8/1937 | Wright | 40/4 |
| 2,170,147 | 8/1939 | Lane | 283/81 X |
| 2,613,168 | 10/1952 | Totten, Jr. | 154/46 |
| 3,203,823 | 8/1965 | Grimes | 117/38 |
| 3,211,470 | 10/1965 | Wilson | 283/18 |
| 3,312,005 | 4/1967 | McElroy | 40/2 |
| 3,517,450 | 6/1970 | Greco | 40/2 |
| 3,750,317 | 8/1973 | Morgan | 40/310 |
| 3,994,089 | 11/1976 | Schwartz | 30/310 |
| 4,128,954 | 12/1978 | White | 40/310 |
| 4,460,634 | 7/1984 | Hasegawa | 428/124 |
| 4,558,888 | 12/1985 | Hanson et al. | 281/21.1 |
| 4,558,980 | 12/1985 | Sturdivan | 412/2 |
| 4,562,938 | 1/1986 | Loder | 221/46 |
| 4,567,681 | 2/1986 | Fumei | 40/310 |
| 4,586,629 | 5/1986 | Loder | 221/46 |
| 4,612,721 | 9/1986 | Fumei | 40/310 |
| 4,661,188 | 4/1987 | Fumei | 156/24.11 |
| 4,726,131 | 2/1988 | Cass | 40/2 R |
| 4,768,810 | 9/1988 | Mertens | 282/12 A |
| 4,770,913 | 9/1988 | Yamamoto | 428/40 |
| 4,822,074 | 4/1989 | Hueffman et al. | 281/2 X |
| 4,895,746 | 1/1990 | Mertens | 428/40 |
| 5,011,186 | 4/1991 | Bodziak et al. | 281/12 |

FOREIGN PATENT DOCUMENTS 512153 11/1992 European Pat. Off. .

*Primary Examiner*—Mark Rosenbaum
*Assistant Examiner*—Willmon Fridie, Jr.
*Attorney, Agent, or Firm*—Nixon & Vanderhye

[57] ABSTRACT

Easily removable labels, which are still permanently placed except when it is desired to remove them, are associated with bottles, cans, or like containers. Two different configurations of the labels are provided. In the first configuration a roll of labels is provided with permanent adhesive strips along the edge of each label being in shingled overlapped engagement with the permanent adhesive release coat of an adjacent label. In a second construction a pad of labels is provided with two different types of labels, each type having spaced strips of permanent adhesive along one edge of each of the top and bottom faces, which are staggered with respect to like strips along the edges of the second type of labels in the pad, the types of labels alternating in the pad, and permanent adhesive release coat material being provided in the spaces between the strips of material.

21 Claims, 2 Drawing Sheets

Fig. 1
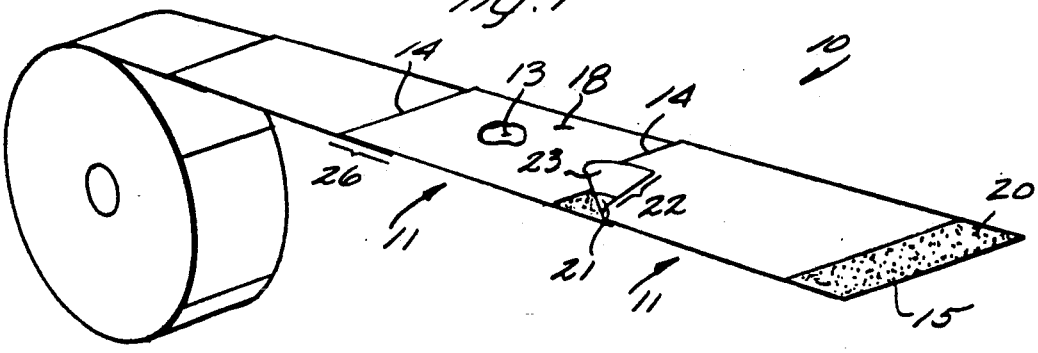
Fig. 2
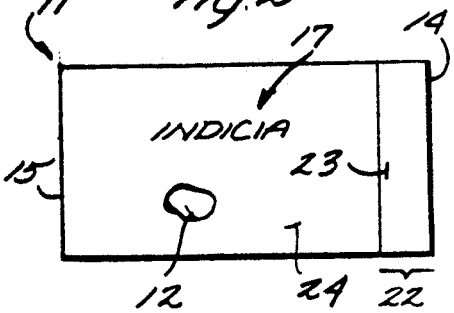
Fig. 3
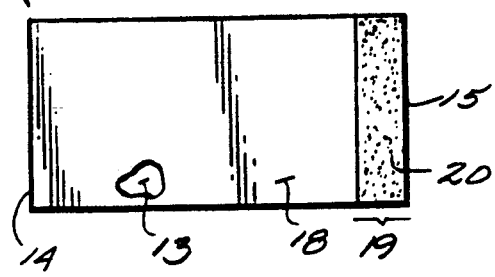
Fig. 4
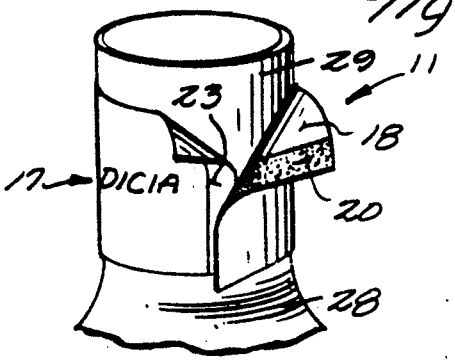
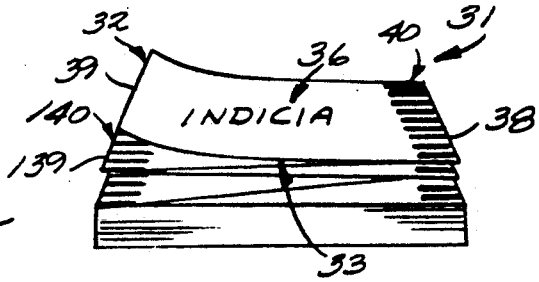
Fig. 5

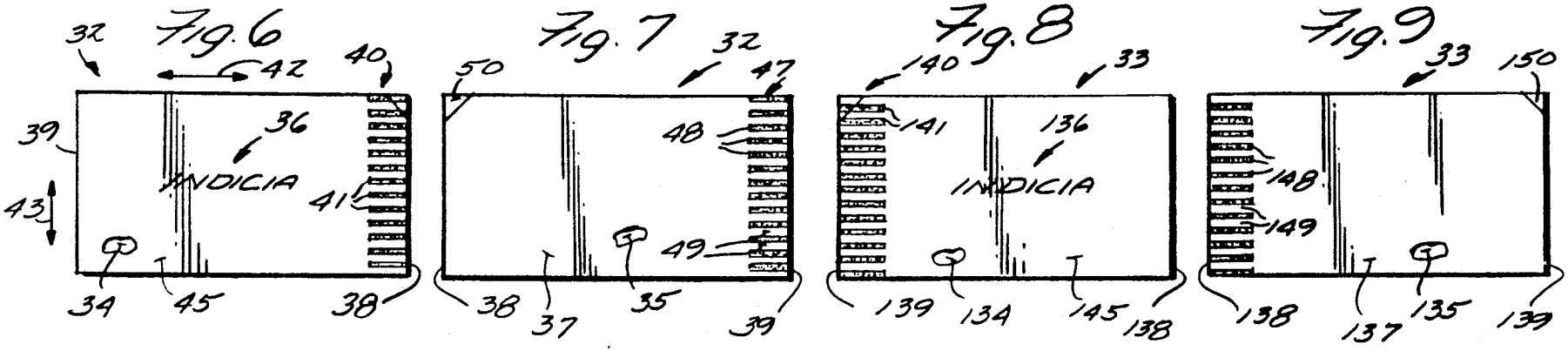
Fig. 6
Fig. 7
Fig. 8
Fig. 9
INDICIA
INDICIA
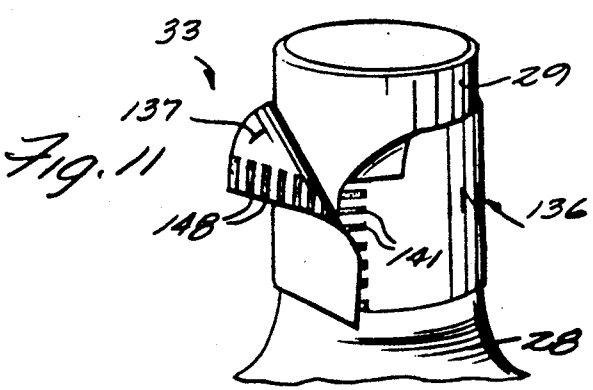
Fig. 11
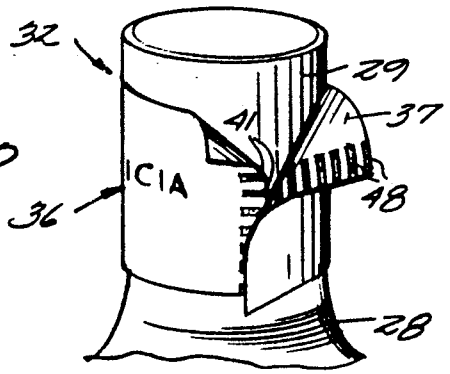
Fig. 10

REMOVABLE LINERLESS LABEL ZIGZAG AND SHINGLED CONSTRUCTIONS

BACKGROUND AND SUMMARY OF THE INVENTION

The present invention relates to an easily removable label that is securely attached to a container yet facilitates recycling by leaving no permanent adhesive residue on the container once the label is separated. The basic concepts of the invention are similar to those in co-pending application Ser. No. 08/012,410 filed Feb. 2, 1993, and are particularly useful in situations where recycling of the container is desired. Utilizing the present invention, permanent adhesive on a label engages only other portions of the label, not the container itself, however the container itself is engaged by removable adhesive (preferably repositional adhesive) so that the label stays firmly in place, yet is readily removed once the label is torn to release the permanent adhesive attachment between free ends thereof.

The labels according to the present invention differ from those in the co-pending application Ser. No. 08/012,410 in the particular configuration in which they are provided, and in the particular location of the adhesive strips associated therewith. There are two basic forms of construction according to the invention. The first form is a roll of labels, with shingled overlapped portions. The second form is a pad of labels comprising first and second alternating types of labels.

According to the first aspect of the present invention, a roll of labels is provided. Each label comprises: h substrate having first and second faces and first and second edges; indicia printed on the first face; a coating of removable adhesive disposed on the second face of the substrate; a pattern of permanent adhesive disposed adjacent the first edge on one face of the substrate, and an adhesive receiving area disposed adjacent the second edge on the other face of the substrate, so as to form a cooperating mating surface for the pattern of permanent adhesive; and a permanent adhesive release coat covering at least a portion of the other face aside from said adhesive receiving area. The labels are in shingled overlapped configuration in the roll with the pattern of permanent adhesive of each label, except the first and the last labels, in the roll in shingled overlapped engagement with the permanent adhesive release coat of an adjacent label, and the permanent adhesive release coat in shingled, overlapped engagement with the permanent adhesive of an adjacent label.

Typically the removable adhesive is repositional adhesive, and the "one" face is the second face while the "other" face is the first face. The permanent adhesive pattern is preferably a strip, and a permanent release coat is provided over the entire first face except for the strip of adhesive receiving area corresponding to the permanent adhesive strip. The repositional adhesive is preferably disposed over the entire second face of the label except where the permanent adhesive is provided.

According to a second aspect of the present invention, a pad of labels is provided for use with containers, comprising first and second alternating types of labels. The first type of label comprises a substrate having first and second faces and first and second edges; indicia printed on the first face; a coating of removable adhesive disposed on the second face; a pattern of permanent adhesive disposed adjacent the first edge of the first face, and a cooperating pattern disposed adjacent the second edge of the second face. And, the second type of label comprises a substrate having first and second faces and first and second edges; indicia printed on the first face; a coating of removable adhesive disposed on the second face; a pattern of permanent adhesive disposed adjacent the second edge of the first face, and a cooperating pattern disposed adjacent the first edge of the second face.

The pad of labels described above also utilizes unique labels. The labels according to this aspect of the invention comprise: A substrate having first and second faces and first and second edges. Indicia printed on the first face. A coating of removable adhesive disposed on the second face of the substrate. A pattern of permanent adhesive disposed adjacent the first edge of the first face, comprising a plurality of strips of permanent adhesive elongated in the dimension between the first and second edges only extending a small portion of the distance between the first and second edges, and spaced from each other in a dimension transverse to the distance between the first and second edges. A permanent adhesive release material covering the first face except at the permanent adhesive pattern. And, a cooperating pattern disposed on the second face adjacent the second edge, the cooperating pattern having spaced strips aligned with the spaced strips on the first face when the label is wrapped around a container portion. The cooperating patterns are also preferably patterns of permanent adhesive.

Also, the invention contemplates a combination of a label with a container. The label has a distance between, the first and second edges thereof greater than the exterior dimensions of the container with which it is to be associated (e.g. bottle neck, bottle body, can circumference, etc.). The label is wrapped around the container exterior so that the edges overlap and the permanent adhesive and cooperating patterns are aligned to hold the label in place, the body of the label being held on the container with the repositional/removable adhesive.

It is the primary object of the present invention to provide simple yet effective configurations for labels to be applied to containers such as bottles and cans. This and other objects of the invention will become clear from an inspection of the detailed description of the invention and from the appended claims.

BRIEF DESCRIPTION OF THE DRAWINGS

FIG. 1 is a top perspective view of an exemplary roll of labels for use with containers, according to a first aspect of the present invention;

FIG. 2 is a top plan view of one of the labels from the roll of FIG. 1;

FIG. 3 is a bottom plan view of the label of FIG. 2;

FIG. 4 is a top perspective view showing the label of FIGS. 2 and 3 being wrapped around a container exterior surface (in this case a bottle neck);

FIG. 5 is a top perspective view of a pad of labels for use with containers, according to a second aspect of the present invention;

FIGS. 6 and 7 are top and bottom plan views, respectively, a first type of label in the pad of FIG. 5;

FIGS. 8 and 9 are top and bottom plan views, respectively, of a second type of label according to the pad of FIG. 5;

FIG. 10 is a top perspective view showing the first type of label, of FIGS. 6 and 7, being placed in operative association with a container exterior surface (bottle neck); and FIG. 11 is a view like that of FIG. 10 only for the second type of label, that of FIGS. 8 and 9.

DETAILED DESCRIPTION OF THE DRAWINGS

FIG. 1 schematically illustrates a roll 10 of labels for use with containers, according to the present invention. Each label 11 of the roll 10 comprises a substrate (e.g. of paper, plastic, or the like) having a first, top, face 12 (see FIG. 2), a second, bottom, face 13 (see FIG. 3), and first and second spaced opposite edges 14, 15, defining the longitudinal ends of the label 11. Indicia 17, which typically tells what is in a container that the label is to be associated with, its trademark, or the like, is printed on the face 12, while a removable adhesive 18 (preferably a repositional adhesive such as CLEANTAC adhesive sold by Moore Business Forms, Inc. of Lake Forest, Ill.) covers the majority of the second face 13 (see FIG. 3).

Also disposed on the second face 13 adjacent the second edge 15 thereof is the pattern of permanent adhesive, the pattern in this case being shown as a strip 19, and the permanent adhesive being shown generally by reference numeral 20. Any conventional permanent adhesive suitable for use with containers, such as food and beverage containers, may be utilized. Disposed on the top face 12 of the label 11 is a cooperating pattern 22, which cooperates with the pattern 19. The pattern 22 preferably comprises a strip of repositional release material 23. That is the material 23 will release readily from a repositional adhesive, but not from a permanent adhesive. The rest of the face 12 aside from the strip 22 preferably is covered with a conventional permanent adhesive release coating (such as silicone) illustrated by reference numeral 24.

By utilizing the label construction illustrated in FIGS. 2 and 3, it is a simple matter to provide labels in shingled, overlapped relationship in the roll 10. Note that the edge 14 of a leading label 11 overlies the edge 15 of the next label 11 in the roll by a distance 26, which is greater than the width of the strip 22. In this way the permanent adhesive 20 engages only the permanent adhesive release coat material 24, while the strip 22, and material 23 thereof, is only engaged by repositional adhesive 18, from which it can readily separate to remove the leading label 11 from the roll as indicated schematically, at the start of removal, for the leading label of the roll 10 in FIG. 1.

Utilizing the labels 11 described with respect to FIGS. 2 and 3, the manner in which they are associated with a container 28, such as the neck 29 of a bottle, is illustrated. In this configuration, the indicia 17 is readable from the exterior of the label 11, and the permanent adhesive 20 engages the material 23, which it can permanently attach to. In most circumstances the adhesive 20 will be pressure sensitive so that after it is placed in contact with the material 23 pressure is merely applied to seal it. However other types of adhesive could also be utilized, such as described in the co-pending application Ser. No. 08/012,410, filed Feb. 2, 1993, the disclosure of which is hereby incorporated by reference herein.

FIGS. 5 through 11 illustrate a second aspect of the present invention, in this case a pad 31 of labels for use with containers being illustrated. The pad 31 includes two different types of labels, a first type 32, and a second type 33, which alternate in the pad.

The first type of label, 32, is illustrated in FIGS. 6 and 7. It includes a substrate of paper, plastic, or the like which has a first, top, face 34 (FIG. 6), and a second, bottom, face 35 (FIG. 7). Printed on the face 34 is indicia 36, while the back face 35 is primarily covered with removable (preferably repositional) adhesive 37. The substrate also has first and second edges 38, 39 spaced from each other in a dimension of elongation 42 of the label 32, the same dimension that the indicia 36 extends in.

Disposed on the top face 34 is a pattern of permanent adhesive shown generally by reference numeral 40. The pattern 40 comprises individual strips 41 of permanent adhesive that are elongated in the dimension 42, and spaced from each other in the dimension 43 (perpendicular to the dimension 42), and extend only a small portion of the distance between the edges 38, 39. The rest of the top face 34 is preferably coated with a permanent adhesive release material 45, including the areas between the strips 41. Disposed on the second face 35, adjacent the edge 39 (that is opposite the edge with which the strips 41 are associated) is a cooperating pattern 47 to the pattern 40. The pattern 47 thus comprises base strips 48 having the same pattern as the strips 41. The strips 48 may either be plain substrate uncoated with repositional adhesive or release material, or may comprise other strips of permanent adhesive comparable to the strips 41. The area between the strips 48 — indicated by 49 in FIG. 7 — is preferably coated with permanent adhesive release material.

The labels 33 of the second type are similar to the labels 32 of the first type except that the edges with which the permanent adhesive patterns are associated are reversed, and also the permanent adhesive pattern strips are interleaved (when overlaid) with the permanent adhesive strips of the labels 32 [that is the permanent adhesive strips from the second type of label 33 are disposed in spaces between the permanent adhesive strips of the labels 32 when the labels are in stack/pad 31]. In the FIGS. 8 and 9 embodiment structures comparable to those in the FIGS. 6 and 7 embodiment are shown by the same reference numeral only preceded by "1".

Note that each of the labels 32, 33 may have a no adhesive zone (e.g. triangular in shape) 50, 150, such a zone being shown per se in co-pending application Ser. No. 08/012,410 filed Feb. 2, 1993.

With the construction illustrated in FIGS. 5 through 11 it will be apparent that the labels 32, 33 may be stacked in the pad 31 without the permanent adhesive portions thereof engaging each other, so that only repositional adhesive 37, 137 holds the labels in the pad 31, so that they may be readily separated (as by grasping the no adhesive zone 50, 150), yet the labels 32, 33 will positively engage a bottle neck 29. However to remove the labels from the bottle all that it is necessary to do is to sever the label 32, 33 substrate adjacent the permanent adhesive 41, 48, 141, 148, portions, and then peel off the label 32, 33 removing the repositional adhesive 37, 137 along with it. To facilitate this detachment a line of weakness, such as a perforation, may be utilized adjacent to the permanent adhesive patterns 40, 140, if desired and as shown per se in co-pending application Ser. No. 08/012,410 filed Feb. 2, 1993.

FIGS. 10 and 11 illustrate use of the first and second types of labels 32, 33, respectively in association with a container 28, in this case a bottle neck 29. In both cases the labels are wrapped around the bottle necks 29 so that the indicia 136, 36 is visible from the exterior of the container 28, with the permanent adhesive strips 41, 48, 141, 148, overlaying each other and sealing the label substrates in place, but not engaging the container 28 exterior surface. However the repositional adhesive 37, 137, does engage the bottle neck 29 to stabilize the label 32, 33.

It will thus be seen that according to the present invention advantageous label assemblies have been provided, particularly for use with containers to facilitate recyclability. While the invention has been herein shown and described in what is presently conceived to be the most practical and preferred embodiment thereof it will be apparent that many other modifications may be made thereof within the scope of the invention, which scope is to be accorded the broadest interpretation of the appended claims so as to encompass all equivalent structures and devices and combinations.

What is claimed is:

1. A roll of labels for use with containers, each label comprising:

a substrate having first and second faces and first and second edges; indicia printed on said first face; a coating of removable adhesive disposed on said second face of said substrate; a pattern of permanent adhesive disposed adjacent said first edge on said first face or said second face, respectively, of said substrate, and an adhesive receiving area disposed adjacent said second edge on said second face or said first face, respectively of said substrate, so as to form a cooperating mating surface for said pattern of permanent adhesive; and a permanent adhesive release coat covering at least a portion of said other face aside from said adhesive receiving area;

said labels being in shingled overlapped configuration in said roll with said pattern of permanent adhesive of each label, except the first and the last labels, in the roll in shingled overlapped engagement with the permanent adhesive release coat of an adhesive label, and the permanent adhesive release coat in shingled, overlapped engagement with the permanent adhesive of an adjacent label.

2. A roll as recited in claim 1 wherein said pattern of permanent adhesive is adjacent said first edge of said second face, and wherein said cooperating mating surface is on said first face.

3. A roll as recited in claim 2 wherein said pattern of permanent adhesive comprises a strip having a width that is a less than half of the length of said substrate between said first and second edges; and wherein said adhesive receiving area comprises a strip having substantially the same width as the width of said permanent adhesive strip.

4. A roll as recited in claim 3 wherein said removable adhesive is repositional adhesive and wherein said adhesive receiving area is coated with repositional release material, but not permanent release material.

5. A roll as recited in claim 4 wherein said permanent release coat covers said entire first face except for said strip of adhesive receiving area.

6. A roll as recited in claim 5 wherein said repositional adhesive covers all of said second face except for said strip of permanent adhesive.

7. A roll as recited in claim 1 wherein said removable adhesive covers all of said second face except for said strip of permanent adhesive.

8. A roll as recited in claim 1 wherein said pattern of permanent adhesive comprises a strip having a width that is a small part of the length of said substrate between said first and second edges; and wherein said adhesive receiving area comprises a strip having substantially the same width as the width of said permanent adhesive strip.

9. A pad of labels for use with containers, comprising first and second alternating types of labels:

said first type of label comprising a substrate having first and second faces and first and second edges; indicia printed on said first face; a coating of removable adhesive disposed on said second face; a pattern of permanent adhesive disposed adjacent said first edge of said first face, and a cooperating pattern disposed adjacent said second edge of said second face; and said second type of label comprising a substrate having first and second faces and first and second edges; indicia printed on said first face; a coating of removable adhesive disposed on said second face; a pattern of permanent adhesive disposed adjacent said second edge of said first face, and a cooperating pattern disposed adjacent said first edge of said second face.

10. A pad as recited in claim 9 wherein said pattern of permanent adhesive comprises a plurality of strips of adhesive elongated in a dimension between said first and second edges of said substrate and extending a small part of the distance between said first and second edges with the area between said strips covered with permanent adhesive release material.

11. A pad as recited in claim 10 wherein the plurality of strips of permanent adhesive on said first and second types of labels are offset from each other so that the permanent adhesive strips on one label engage release material between the strips on a face to face label.

12. A pad as recited in claim 11 wherein said cooperating pattern of each of said first and second types of labels comprises a cooperating pattern of permanent adhesive with permanent adhesive release material between the strips thereof.

13. A pad as recited in claim 12 wherein said removable adhesive is repositional adhesive.

14. A pad as recited in claim 13 further comprising release material covering said first face except at said permanent adhesive pattern.

15. A pad as recited in claim 10 further comprising release material covering said first face except at said permanent adhesive pattern.

16. A pad as recited in claim 9 further comprising permanent adhesive release material covering said first face except at said permanent adhesive pattern.

17. A pad as recited in claim 9 wherein said removable adhesive is repositional adhesive.

18. A label for use with a container, comprising:

a substrate having first and second faces and first and second edges;

indicia printed on said first face;

a coating of removable adhesive disposed on said second face of said substrate;

a pattern of permanent adhesive disposed adjacent said first edge of said first face, comprising a plurality of strips of permanent adhesive elongated in the dimension between said first and second edges only extending less than half of the distance between said first and second edges, and spaced from each other in a dimension transverse to the distance between said first and second edges;

a permanent adhesive release material covering said first face except at said permanent adhesive pattern; and a cooperating pattern disposed on said second face adjacent said second edge, said cooperating pattern having spaced strips aligned with the spaced strips on said first face when said label is wrapped around a container portion.

19. A label as recited in claim 18 wherein said cooperating pattern also comprises permanent adhesive, and further comprising release material between the spaced strips of said cooperating pattern.

20. A label as recited in claim 18 wherein said removable adhesive is repositional adhesive.

21. A container and label combination comprising:

a container having an exterior surface having a circumference;

a label substrate having first and second faces in a generally quadrate configuration, and first and second opposite edges, said first and second edges spaced from each other a distance greater than said container circumference, said substrate wrapped around said container exterior surface with said first and second edges overlapping each other;

indicia printed on said first face;

a coating of removable adhesive disposed on said second face of said substrate;

a pattern of permanent adhesive disposed adjacent said first edge of said first face, comprising a plurality of strips of permanent adhesive elongated in the dimension between said first and second edges only extending less than half of the distance between said first and second edges, and spaced from each other in a dimension transverse to the distance between said first and second edges;

a permanent adhesive release material covering said first face except at said permanent adhesive pattern; and a cooperating pattern disposed on said second face adjacent said second edge, said cooperating pattern having spaced strips aligned with the spaced strips on said first face when said label is wrapped around a container portion.

* * * * *